United States Patent [19]

Van Horn

[11] Patent Number: 4,837,534

[45] Date of Patent: Jun. 6, 1989

[54] CERAMIC BLOCK FILTER WITH BIDIRECTIONAL TUNING

[75] Inventor: Mark I. Van Horn, Bedford, Tex.

[73] Assignee: Motorola, Inc., Schaumburg, Ill.

[21] Appl. No.: 150,251

[22] Filed: Jan. 29, 1988

[51] Int. Cl.[4] ..... H01P 1/202; H01P 7/04

[52] U.S. Cl. ..... 333/207; 333/223

[58] Field of Search ..... 333/202, 203, 206, 207, 333/227, 223, 235

[56] References Cited

U.S. PATENT DOCUMENTS

| | | | |
|---|---|---|---|
| 4,157,517 | 6/1979 | Kheisel et al. | 333/205 |
| 4,431,977 | 2/1984 | Sokola et al. | 333/206 |
| 4,523,162 | 6/1985 | Johnson | 333/203 X |
| 4,675,632 | 6/1987 | Kawano | 333/272 |
| 4,691,179 | 9/1987 | Blum et al. | 333/202 |
| 4,733,208 | 3/1988 | Ishikawa et al. | 333/202 |

FOREIGN PATENT DOCUMENTS

| | | | |
|---|---|---|---|
| 73501 | 5/1982 | Japan | 333/202 |
| 39902 | 3/1985 | Japan | 333/234 |
| 52102 | 3/1985 | Japan | 333/223 |
| 62203 | 3/1986 | Japan | 333/219 |

*Primary Examiner*—Eugene R. LaRoche
*Assistant Examiner*—Benny Lee
*Attorney, Agent, or Firm*—Melvin A. Schectman; Wayne J. Egan

[57] ABSTRACT

Coupled transmission line resonators, such as those in a solid-dielectric ceramic block filter, are fabricated with tuning regions formed by notches in the outer conductor extending longitudinally parallel with the inner conductors from both the low-impedance ends and the high-impedance ends of the resonators. Removing conductive material from the notches in the vicinity of the low-impedance ends of the resonators decreases their resonant frequencies; removing conductive material from the notches in the vicinity of their high-impedance ends increases their resonant frequencies. Sensitivity of tuning depends on the depth of the notches. By situating all tuning regions along a common side of a filter, tuning both higher and lower in frequency may be accomplished without a need to re-orient the filter in a production-line fixture.

8 Claims, 2 Drawing Sheets

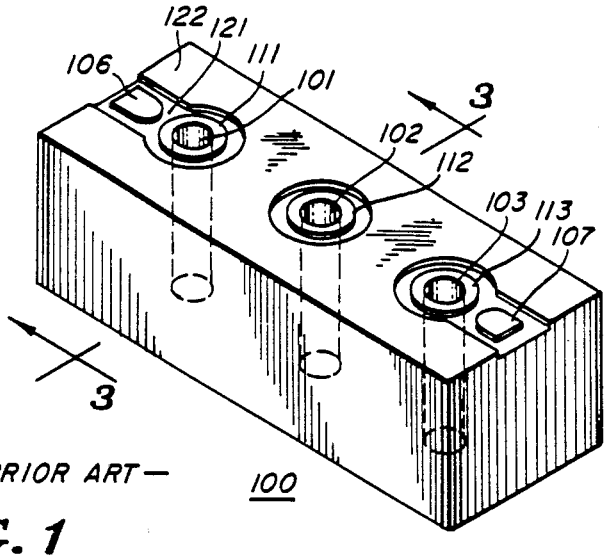
—PRIOR ART—
FIG. 1
FIG. 2A
—PRIOR ART—
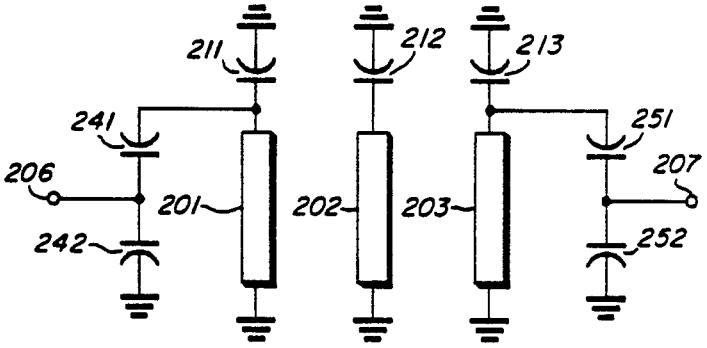
FIG. 2B
—PRIOR ART—
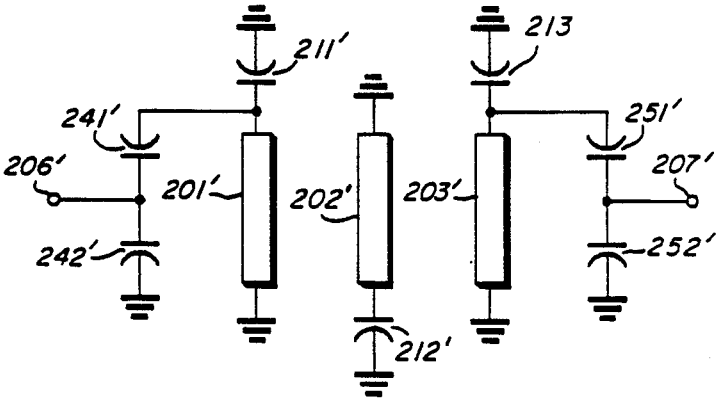

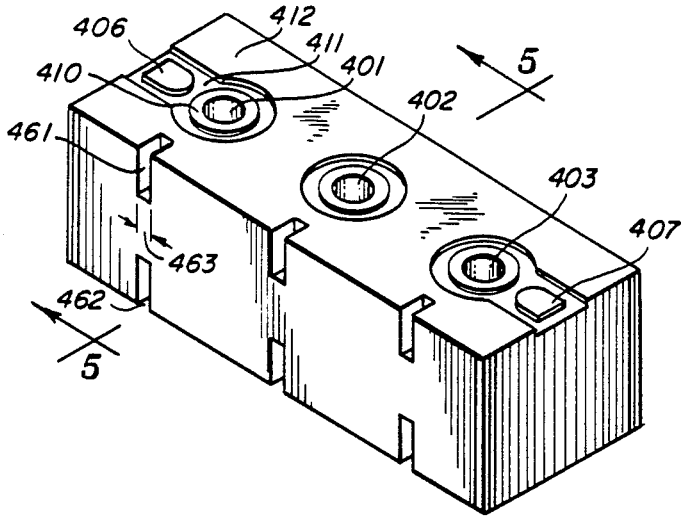
FIG. 4
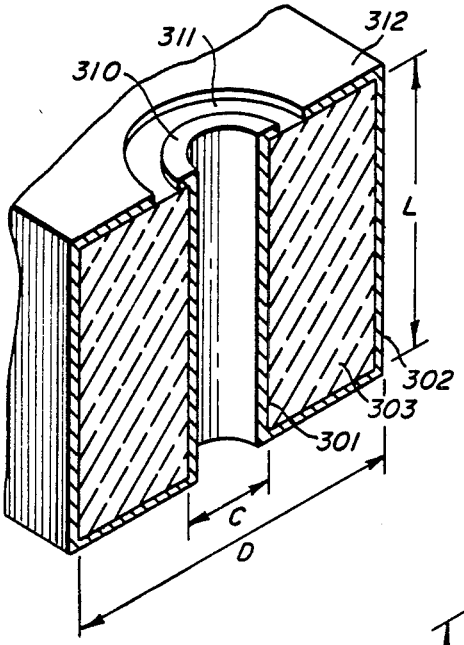
FIG. 3
— PRIOR ART —
FIG. 5
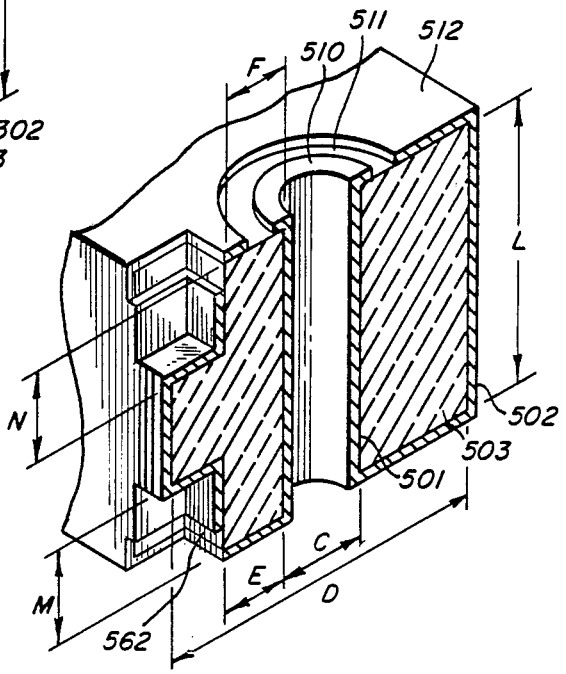

CERAMIC BLOCK FILTER WITH BIDIRECTIONAL TUNING

BACKGROUND OF THE INVENTION

1. Technical Field of the Invention

This invention pertains to an improved method of tuning resonant transmission line structures such as those used in high-dielectric-constant, coupled-resonator wave filters.

2. Description of the Prior Art

U.S. Pat. No. 4,431,977, "Ceramic Bandpass Filter," issued Feb. 14, 1984, to Sokola et al., describes ceramic dielectric block filters using resonant transmission line structures to which the tuning method of this invention may be applied. FIG. 1 illustrates a combline filter (100) comprising three transmission line resonators (101, 102, and 103), each having its inner conductor short-circuited to its outer conductor at one end and loaded by a capacitance (e.g. 111, 112 113) at its other end. Electrical signals couple to the filter at an input pad (106) and from the filter at an output pad (107).

FIG. 2*a* shows an electrical equivalent circuit of the filter of FIG. 1. FIG. 2*a* represents the equivalent circuit of the combline filter depicted in FIG. 1. Since resonators 101, 102, 103 in FIG. 1 are grounded on identical ends, the equivalent resonators 201, 202, 203 in FIG. 2*a* are also grounded on the same ends. Also, capacitors 211, 212, 213 in FIG. 2a represent loading capacitors 111, 112, 113 in FIG. 1. Capacitors 241, 242 of FIG. 2*a* represent capacitances formed by input pad 106 of FIG. 1. Also, capacitors 251, 252 of FIG. 2*a* represent capacitances formed by output pad 107 of FIG. 1. The input signal at input point (206) couples through a capacitive divider (241–242) between the metallization of pad 106, disc 111, and ground 122. Each resonator (201, 202, and 203) is a transmission line of slightly less than one-quarter wave electrical length; loading capacitors (211, 212, and 213) provide sufficient capacitance to resonate the transmission lines. Output couples from the filter through a similar capacitive divider (251–252) to an output point (207). The response of the filter depends on the electrical parameters of the resonators, on the coupling between resonators, and on the input and output loading. As FIG. 2*b* illustrates, coupled line filters have also been realized as interdigital structures, in which the relative positions of the short-circuited ends and capacitively-loaded ends of the transmission lines alternate. For example, compare the center resonators (202 and 202') of the two equivalent circuit. Further note resonator 202 of the combline filter in FIG. 2*a* is grounded on the same side as the other resonators of the same filter, whereas resonator 202' of the interdigital filter in FIG. 2*b* is grounded on the opposite side as the other resonators of the same filter. Also, compare the input points (206 and 206') of the two equivalent circuits.

FIG. 3 is a cross-sectional detail of a typical prior art dielectric block resonator. The structure may be fabricated from a block that is plated with a conductive coating on its exterior surfaces and on the inner surfaces of the holes. The conductive coating forms both the inner conductor (331) and outer conductor (332) of a transmission line that is short-circuited at one end and capacitively loaded at the other end. A plated region in the form of a conductive disc (311), which is joined to the inner conductor and spaced from the ground plating (322) by a gap (321), provides the capacitive loading.

The dimensions of the resonator structure and the dielectric constant of the filler medium (333), which is typically a ceramic such as barium titanate, determine its characteristic impedance and resonant frequency. In FIG. 3, the diameter of the inner conductor of the resonator is designated C, the width of the outer conductor of the resonator is designated D, and the length of the resonator is designated L. The loading capacitance allows the structure to resonate at a frequency slightly below that at which it has one-quarter wave electrical length.

Design of a filter generally requires that each resonator have a specified resonant frequency and coupling to adjacent resonators. Manufacturing tolerances in the dielectric constant and in the physical dimensions require that production filters be tuned after fabrication. Coupling has been adjusted by various prior art methods, including slotting the dielectric between resonators or modifying the conductive plating pattern between the capacitively-loaded, high-impedance ends of the resonators.

Prior art tuning methods have proven inconvenient in production. One method is to provide a grounded tuning screw that protrudes into the dielectric towards the inner conductor in the vicinity of its high-impedance end. Rotation of the screw varies its insertion, which changes the capacitive loading to the resonator. Tuning screws are unsuitable for many practical applications because of their bulk and mechanical instability.

Another method is to abrasively remove conductive material to decrease the loading capacitance and thereby raise the resonant frequency. Because the method cannot lower the frequency, the resonator must be designed so that it will be manufactured below the required value, taking into account production tolerances, and then trimmed higher to the target frequency.

Other methods have addressed bidirectional tuning, that is, the ability to tune either higher and lower in frequency. U.S. Pat. No. 4,157,517, entitled *Adjustable Transmission Line Filter and Method of Constructing Same,* describes a method of tuning a stripline resonator by removal or addition of ground plane material covering its high-impedance end.

A presently copending U.S. Patent application entitled *Adjustable Electronic Filter and Method of Tuning Same* Ser. No. 081264, filed July 31, 1987), which is assigned to the assignee of this application, describes another bidirectional tuning method. Removing conductive material from the capacitive loading element tunes a resonator higher in frequency; removing material around part of the circumference of the inner conductor where it joins the outer conductor plating causes the equivalent inductance of the short-circuit to increase, which lowers the resonant frequency. If the resonator has been fabricated with some conductive material omitted, or if some has been removed, conductive material such as metallic paint may be applied to tune in the opposite directions.

These prior art methods suffer drawbacks that make production tuning inefficient: they require that access be available to opposite ends of the resonator according to the direction of tuning, that two steps be carried out (conductor removal and addition), or that all resonators be designed below target frequency. Tuning of interdigital resonators, which have alternating orientations, requires that both ends be available if the same tuning mechanism is to be used. Furthermore, no prior art method has provided effective means to vary tuning sensitivity, that is, the change in frequency for an incremental change in the amount of conductive material.

SUMMARY OF THE INVENTION

According to the invention, a transmission line resonator, which has a low-impedance end at which its inner conductor is short-circuited to its outer conductor and a high-impedance end at which its inner conductor is open-circuited from or loaded by capacitance to its outer conductor, is fabricated with tuning regions extending along parts of the length of the resonator from both the low-impedance end and the high-impedance end of the resonator. Removing conductive material from the tuning region in the vicinity of the low-impedance end of the resonator decreases its resonant frequency; removing conductive material from the tuning region in the vicinity of the high-impedance end of the resonator increases its resonant frequency. The tuning regions may be fabricated as notches or grooves in a dielectric medium surrounding the inner conductor to cause the outer conductor to protrude toward the inner conductor, which decreases the characteristic impedance of the resonator in the tuning regions and increases the tuning sensitivity. If the tuning regions have been fabricated with conductive material initially omitted, or if material has been removed, tuning in opposite directions may be accomplished by addition of conductive material.

The invention facilitates production tuning of coupled resonator structures such as ceramic block combline and interdigital filters. Locating the tuning regions along a side of a filter, rather than at its top and bottom ends as in the prior art, allows tuning both higher and lower in frequency without a need to re-orient the filter in a production-line fixture.

BRIEF DESCRIPTION OF THE DRAWINGS

The invention may be better understood by reference to the Drawing, in which:

FIG. 1 shows a prior art ceramic-block combline filter with three coupled transmission-line resonators, each foreshortened by a loading capacitance;

FIG. 2 shows electrical equivalent circuits of: (a), the coupled-line filter of FIG. 1 and (b), a coupled-line interdigital filter;

FIG. 3 is a perspective cross-sectional diagram of the filter of FIG. 1 taken at section line 3—3, which shows details of resonator structure;

FIG. 4 is an example of a ceramic-block combline filter that provides for adjustment of resonator frequency according to the principles of this invention; and FIG. 5 is a perspective cross-sectional diagram of the filter of FIG. 4 taken at section line 5—5, which shows details of the resonator structure including provision for tuning according to this invention.

DETAILED DESCRIPTION OF THE PREFERRED EMBODIMENT

The preferred embodiment of the invention is a ceramic block coupled-resonator filter, such as that shown in FIG. 4 and perspective cross-sectional view FIG. 5. The filter (400) comprises a dielectric block with holes (401, 402, and 403) that form the inner conductors of TEM-mode foreshortened quarter-wave transmission-line resonators. In FIG. 4, the input pad is designated 406, the output pad is designated 407, and ground is designated 422. The block is plated on the exterior and through the holes with an electrically conductive conformal coating to produce transmission lines in a dielectrically-loaded enclosure.

As shown, the transmission lines have circular cross-section inner conductors in a rectangular parallelepiped outer conductor; however, the conductors may have other cross-section shapes. Each transmission line is effectively short-circuited at that end at which the inner conductor plating is continuous with the outer conductor. At the opposite end, the plating pattern forms a lumped capacitance between ground and a disc (411), which overlaps the inner conductor, separated from ground by an unplated ring (421). In a typical tune-up procedure, such as the well-known Dishal's method, each resonator initially may be short-circuited to ground by plating bridges across the capacitive gap regions.

As has been discussed above, the resonant frequency of the resonator may be tuned by removing conductive plating material from the outer conductor in the vicinity of the tuning regions. Further, the applicant has discovered the sensitivity of this tuning process may be enhanced by decreasing the spacing between the inner and outer conductors in the vicinity of the tuning regions. According to the preferred embodiment, this decrease in spacing between the inner and outer conductors in the vicinity of the tuning regions is accomplished by installing a notch, or groove, in the ceramic block in the vicinity of each tuning region prior to applying the conductive coating material which, once applied, forms the outer conductor. Since the process of installing the notch, or groove, necessarily results in a decrease in the thickness of the ceramic dielectric material separating the outer and inner conductors, this "notching" process results in tuning regions having enhanced sensitivity when compared to corresponding tuning regions without such notches, or grooves. While it is desirable to equip the tuning regions with notches, or grooves, in order to increase the sensitivity of the tuning process, in what follows, however, it must be understood that such notches, or grooves, are not essential to the tuning process. Therefore, the grooves, or notches, may be omitted in an alternate embodiment of the invention.

As discussed above, in the preferred embodiment each resonator is provided with tuning regions formed with notches (461 and 462) in the dielectric medium along a common side of the coupled-line structure. The conductive plating conforms to the shape of the notches and causes the outer conductor to protrude toward the inner conductor to decrease the characteristic impedance of the resonator in the vicinity of the tuning regions. The notches, further illustrated in perspective cross-sectional view FIG. 5, are rectangular grooves that run parallel with the lengths of the resonators and are centered on the axis of each inner conductor.

The width (463) of each groove would typically be less than half the diameter of the inner conductor (dimension "C" in FIG. 5); greater widths can significantly affect coupling between resonators. The extension of either groove from the low-impedance end ("M") or from the high-impedance end ("N") should be limited to approximately 15 electrical degrees along the length of the resonator. The depth of the groove should leave the distance between inner conductor and outer conductor ("E" or "F") at least approximately half of the dimension without the groove. In FIG. 5, the width of the outer conductor of the resonator is designated D, and the length of the resonator is designated L. Note that FIG. 5 is a cross-sectional view of FIG. 4 and, therefore, elements 511, 521, and 522 of FIG. 5 correspond to elements 411, 421, and 422 of FIG. 4, respectively.

The tuning regions at the high- and low-impedance ends of the resonators may be considered capacitive and inductive tuning regions, respectively. Near its resonance frequency, a capacitively loaded quarter-wave transmission-line resonator may be thought of as a section of transmission line with an equivalent lumped inductance to ground at the low-impedance end and an equivalent lumped capacitance to ground at the high-impedance end. Removing conductor material at the low-impedance end increases the equivalent inductance and decreases the resonant frequency; whereas removing conductor material from the tuning region at the high-impedance end of the resonator decreases the equivalent capacitance and increases the resonant frequency. Thus, the same mechanical action can tune a resonator in opposite directions depending on the site at which it is applied.

In the preferred plated embodiment, outer conductor material is removed from the groove faces closest to the inner conductors (561 or 562); however, removing material from other faces will also accomplish tuning. alternatively, the faces may be initially unplated; then conductive material may be applied to tune the resonators in opposite directions by decreasing the equivalent inductance or increasing the equivalent capacitance, according to the region in which the material is added.

While rectangular grooves have been shown for the tuning notches, other configurations that reduce the spacing between the outer conductor and inner conductors to decrease the characteristic impedance in the vicinity of the tuning regions, for example vee-grooves and semi-circular grooves, may be used. Furthermore, for ease of manufacture, the ceramic dielectric block may be pressed with a single, continuous groove running along the full length of each resonator. For the reasons mentioned earlier, removal of conductive plating material from the full length grooves should be restricted to designated regions extending less than approximately 15 electrical degrees longitudinally from either the low-impedance or high-impedance ends of the resonators.

An important feature of the invention is that it provides a means for varying the sensitivity of the tuning mechanism. The notches create regions of reduced characteristic impedance, which enhances the effect of tuning adjustments. Designing the resonators with reduced depth notches or grooves decreases the sensitivity of tuning adjustments. In the limit, the notches may be reduced to flat windows, along at least one face of an un-notched block, from which conductor material may be removed or added.

Tuning a resonator according to the method of the invention has a slight effect on resonator unloaded "Q."In particular, it is preferred to tune more extensively at the capacitive, high-impedance end, rather than at the low-impedance end, because removing too much of the outer conductor at the low-impedance end affects the path of the ground currents, which can cause higher-order modes to be coupled to (rather than TEM) and can degrade Q. The extent of non-ideal effects depends on how much tuning is required, which depends on manufacturing tolerances in the resonator dimensions and dielectric constant. An important advantage of practicing the invention is that resonators may be designed to be exactly on frequency, because the tuning method can adjust for manufacturing tolerances that produce resonators both too high and too low in frequency.

The method of the invention can be applied to transmission-line resonators in a variety of structures, including monotonic all-pole prototype filters and elliptic-function filters with transmission zeroes, and it may be applied to different arrangements of resonators, such as interdigital and combline filters. Because the tuning regions may all be situated along a single, common side of a filter, rather than at the top and bottom ends as in the prior art, there is no need to re-orient the filter or a tuning fixture during production-line tuning. The tuning technique can be applied advantageously to filters used in radio communication at ultra-high frequencies, such as individual ceramic block resonator preselectors and injection filters, and multiple filters, such as signal splitters, combiners, and duplexers. The invention may also be applied to structures in which not all resonators have identical lengths.

Typical dimensions of a filter having a bandwidth of the order of 10 to 30 MHz, for use in the 450 or 800 MHz UHF communications bands, would be a resonator length of about 0.4 to 0.7 inches, with typical loading capacitance of 2 to 4 pF, outer-conductor spacing (D) of approximately 0.6 to 0.8 inches and inner conductor diameter (C) of about 0.1 to 0.2 inches. Dielectric media in common use are, for the 800 MHz band, barium tetratitanate (dielectric constant approximately 37) and, in the 450 MHz band, barium-neodymium-titanate (dielectric constant approximately 80). Typical characteristic impedance with these materials is between 10 and 15 ohms. For these dimensions, a typical width of tuning notch would be 0.01 inches or less.

Those skilled in the art will recognize that the invention is not limited to the particular embodiment described in this specification and that it may be applied in a variety of resonator applications as encompassed by the appended claims.

What is claimed is:

1. A transmission-line resonator having a length and having a resonant frequency that may be tuned, comprising:

(a) an inner conductor;

(b) an outer conductor comprising conductive material and substantially surrounding said inner conductor thereby forming a spacing between said inner conductor and said outer conductor;

(c) a dielectric medium disposed between said inner conductor and said outer conductor;

(d) a low-impedance end at which said inner conductor is electrically connected to said outer conductor;

(e) a high-impedance end;

said resonator having a first tuning region aligned with and extending along a first part of said length proximate to said low-impedance end, wherein removal of said conductive material from said first tuning region will decrease said resonant frequency; and, said resonator having a second tuning region extended along and aligned with a second part of said length proximate to said high-impedance end, wherein removal of said conductive material from said second tuning region will increase said resonant frequency.

2. The resonator of claim 1 in which said spacing between said inner conductor and said outer conductor is reduced in the vicinity of said first tuning region and said second tuning region.

3. The resonator in claim 1 in which said dielectric medium is a high dielectric-constant ceramic.

4. A transmission line filter having at least one resonator having a length and a resonant frequency that may be tuned, said resonator comprising:

(a) an inner conductor;

(b) an outer conductor comprising conductive material and substantially surrounding said inner conductor thereby forming a spacing between said inner conductor and said outer conductor;

(c) a dielectric medium disposed between said inner conductor and said outer conductor;

(d) a low-impedance end at which said inner conductor is electrically connected to said outer conductor;

(e) a high-impedance end;

wherein said resonator has a first tuning region aligned with and extending along a first part of said length proximate to said low-impedance end of said resonator, wherein removal of said conductive material from said first tuning region will decrease said resonant frequency; and said resonator has a second tuning region extending along and aligned with a second part of said length proximate to said high-impedance end of said resonator, wherein removal of said conductive material from said second tuning region will increase said resonant frequency.

5. The filter of claim 4 wherein said spacing between said inner conductor and said outer conductor is reduced in the vicinity of said first tuning region and said second tuning region.

6. The filter of claim 4 wherein said first tuning region and said second tuning region of said at least one resonator extend along a common side surface of said filter.

7. The filter of claim 4 wherein said dielectric medium is a high dielectric-constant ceramic.

8. In a transmission line filter having at least one resonator having a length and having a resonant frequency that may be tuned, said resonator comprising:

(a) an inner conductor;

(b) an outer conductor comprising conductive material and substantially surrounding said inner conductor thereby forming a spacing between said inner conductor and said outer conductor;

(c) a dielectric medium disposed between said inner conductor and said outer conductor;

(d) a low-impedance end at which said inner conductor is electrically connected to said outer conductor;

(e) a high-impedance end;

said resonator having a first tuning region aligned with and extending along a first part of said length proximate to said lowimpedance end; and said resonator having a second tuning region extending along and aligned with a second part of said length proximate to said highimpedance end, a method for tuning said resonant frequency, comprising the steps of:

(1) removing said conductive material from said first tuning region to decrease said resonant frequency; and (2) removing said conductive material from said second tuning region to increase said resonant frequency.

* * * * *